United States Patent [19]

Kohl

[11] Patent Number: 5,014,523

[45] Date of Patent: May 14, 1991

[54] ICE MACHINE

[75] Inventor: Vance L. Kohl, Manitowoc, Wis.

[73] Assignee: The Manitowoc Company, Inc., Manitowoc, Wis.

[21] Appl. No.: 563,099

[22] Filed: Aug. 3, 1990

[51] Int. Cl.[5] ..... F25C 1/12

[52] U.S. Cl. ..... 62/347; 62/352

[58] Field of Search ..... 62/347, 348, 352, 72, 62/73

[56] References Cited

U.S. PATENT DOCUMENTS

| | | | |
|---|---|---|---|
| 1,528,043 | 3/1925 | Bennett | 62/345 |
| 1,742,194 | 1/1930 | Bennett | 62/345 |
| 1,857,122 | 5/1932 | Sherman | 62/345 |
| 1,999,108 | 4/1935 | Osuch | 62/345 |
| 2,026,214 | 12/1935 | Chilton | 62/345 |
| 2,054,074 | 9/1936 | Field | 62/73 |
| 2,142,386 | 1/1939 | Tietz | 62/345 |
| 2,602,304 | 7/1952 | Randell | 62/345 |
| 2,616,271 | 11/1952 | Knowles | 62/345 |
| 2,732,690 | 1/1956 | Henderson | 62/73 |
| 2,803,950 | 8/1957 | Bayston | 62/345 |
| 2,927,440 | 3/1960 | Kohl | 62/348 X |
| 3,037,366 | 6/1962 | Field | 62/347 X |
| 3,159,011 | 12/1964 | Kaluzny et al. | 62/345 |
| 3,199,309 | 8/1965 | Brubaker | 62/345 |
| 3,253,425 | 5/1966 | McKissick | 62/345 |
| 3,309,892 | 3/1967 | O'Connell et al. | 62/345 |
| 3,580,007 | 5/1971 | Bauerlein | 62/345 |
| 3,727,426 | 4/1973 | Kesling | 62/72 X |
| 3,762,181 | 10/1973 | Leidig | 62/320 |
| 3,791,166 | 2/1974 | Maleck | 62/345 X |
| 4,206,614 | 6/1980 | Albritton | 62/347 X |
| 4,354,360 | 10/1982 | Fiske | 62/320 |
| 4,845,955 | 7/1989 | Taylor | 62/71 |
| 4,898,002 | 2/1990 | Taylor | 62/71 |

*Primary Examiner*—William E. Tapolcai

*Attorney, Agent, or Firm*—Leydig, Voit & Mayer, Ltd.

[57] ABSTRACT

An ice cube making machine having a vertically oriented ice forming mold over which water is circulated from an underlying sump. The ice forming mold includes an endless conveyor for delivering the formed ice upwardly to a chute which communicates with an adjacent, laterally spaced ice storage bin.

7 Claims, 5 Drawing Sheets

ICE MACHINE

FIELD OF THE INVENTION

The present invention relates to an ice making mechanism and, more particularly, to an ice machine having a compact vertically-oriented ice forming and harvesting system.

BACKGROUND OF THE INVENTION

Ice making systems that provide ice for fountain-dispensed soft drinks should produce either small ice cubes or ice chips. Ice in these forms is easier to handle and store than larger ice cubes, and is more economical to produce than crushed ice, which is usually composed of smaller particles.

In designing an ice machine for producing small ice cubes or ice chips, it is desirable that the machine be energy efficient and mechanically simple, while at the same time providing high output capacity. In many applications, it is also desirable that the machine be compact. When, for example, the ice machine is to be installed under a serving counter, as in a restaurant or lounge, the free height available must house the evaporator, condenser, compressor, ice machine and storage bin. In addition, the level of ice in the storage bin must be kept relatively high, so that the ice is easily accessible.

Many commercial ice machines locate the evaporator and ice mold above the ice storage bin, since the ice is usually harvested and directed to the storage bin by gravity. For this reason, the storage bin is generally located at a position directly below the lowermost portion of the evaporator or ice forming mold. Such an arrangement, while well suited for use in hotels and commercial kitchens, is not readily adaptable for use in compact spaces, such as though those under a serving counter, since the combined height of the storage bin and the evaporator results in a machine that is too tall for these applications.

OBJECTS AND SUMMARY OF THE INVENTION

It is, therefore, an object of the present invention to provide an ice machine which is compact and will fit beneath a serving counter. A related object is the provision of an ice machine in which the ice storage bin is readily accessible.

A more specific object of the invention is to provide an ice machine with a compact ice forming and harvesting mechanism which is capable of producing large quantities of clear ice. A related object of the invention is to provide a mechanism for making cubed ice wherein the ice cubes are well formed, frozen and maintain good form and shape when delivered to the ice storage bin.

In accordance with the present invention, these objects are realized by the provision of a vertically oriented ice forming system which incorporates an endless conveyor for delivering the formed ice upwardly to a chute which communicates with an adjacent, laterally spaced ice storage bin. Other objects and advantages of the invention will become apparent upon studying the following description and upon reference to the accompanying drawings.

While the invention will be described in connection with a preferred embodiment, it will be understood that the invention is not limited to those embodiments. On the contrary, we intend to cover all alternatives, modifications and equivalents as may be included within the spirit and scope of the invention as defined by the appended claims.

DESCRIPTION OF THE PREFERRED EMBODIMENTS OF THE INVENTION

Figure 1:
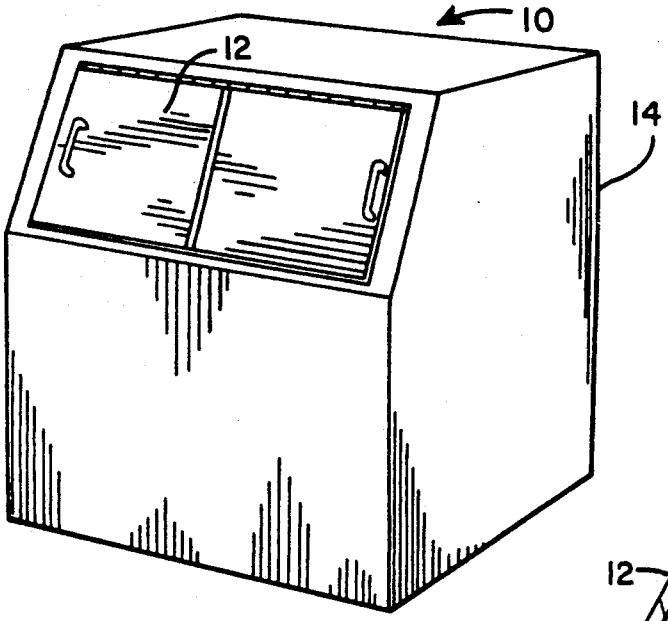
FIG. 1 is a perspective view of the ice machine of the present invention.

FIG. 1 illustrates the design of an ice machine 10 which incorporates the present invention. The machine is sized to fit beneath a serving counter, and includes an ice storage bin, which is accessible by opening door 12. The major components of the machine 10 are enclosed in the rearward section 14 thereof, as illustrated generally in FIG. 2.

Figure 2:
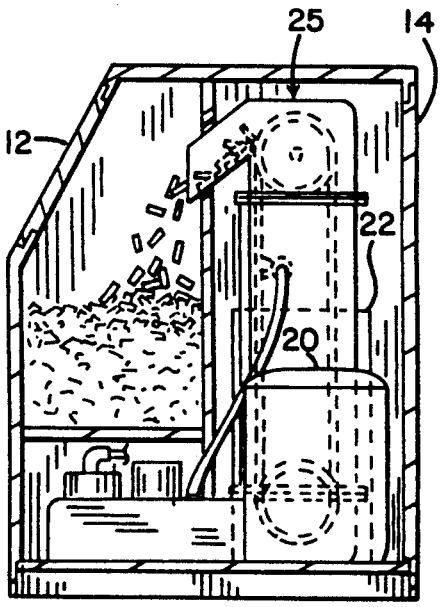
FIG. 2 is a vertical front-to-back cross section of the ice making machine of the present invention showing the relative locations of the ice storage bin, the compressor, the condenser, and the ice forming and harvesting mechanism.
Figure 4:
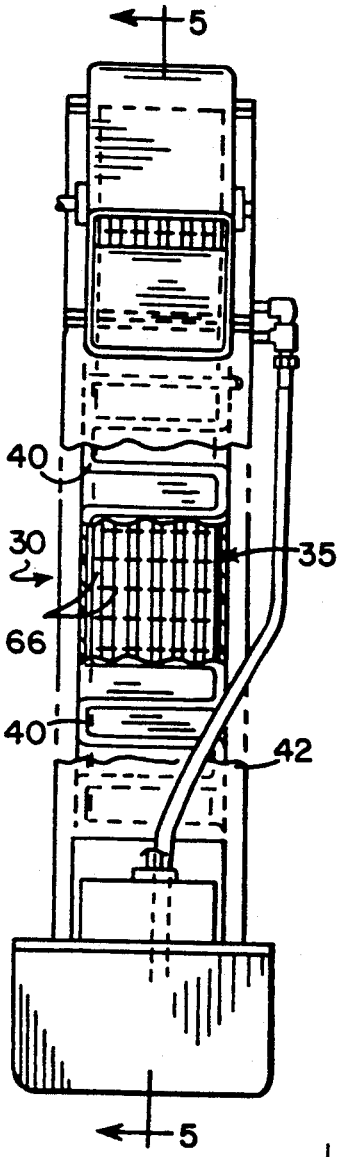
FIG. 4 is a front elevational view of the ice-forming and harvesting mechanism of the present invention, with portions cut away for clarity.
Figure 5:
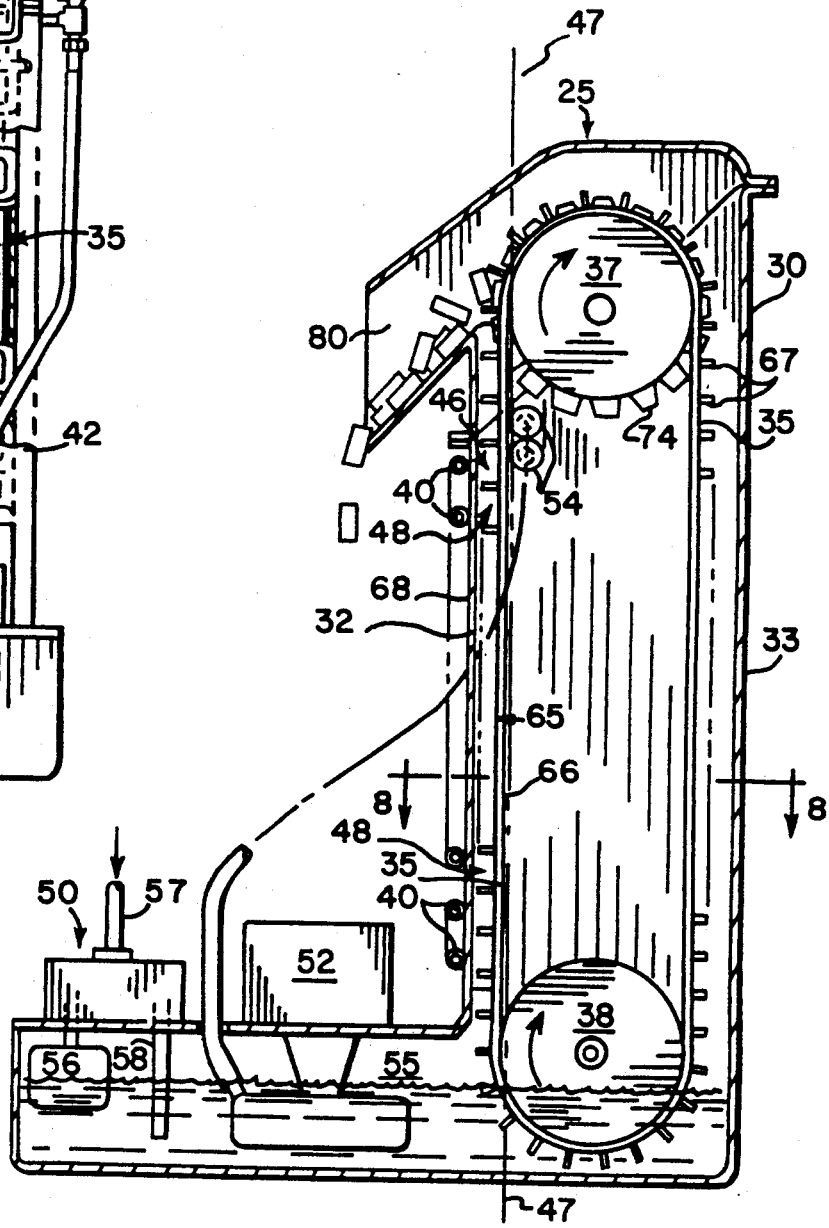
FIG. 5 is a cross sectional view of a preferred embodiment of the ice forming and harvesting mechanism taken along line 5—5 of FIG. 4.

The refrigeration apparatus, as shown in FIG. 2, includes a compressor 20, a condenser 22, and an ice cube freezing mechanism 25, which is more clearly shown in FIGS. 4 and 5. The ice cube freezing structure includes a housing 30, as also shown in cross-section in FIG. 8, having first and second side walls 32, 33. An endless substantially vertically oriented conveyor 35 is located within the housing and translates about first and second pulleys or wheels 37, 38, which reverse the direction of the conveyor. The evaporator coils 40 are placed in close thermal contact with the first side wall 32, and are covered by an insulating material 42. An ice forming chamber 46 is thus defined by the side wall 32 and surface line 47 and contains an ice forming mold, shown generally as 48, which is divided into cube cells 49 as will be described in greater detail below.

A preferred embodiment of the ice making system of the present invention is shown in more detail in FIG. 5. The ice making system includes a water recirculation system 50, including a recirculating pump 52 connected to a header or fountain 54 preferably located above the ice forming mold 48. Header 54 has an even distribution of holes along one side from which water flows at an even and controlled rate over the top of the mold and into cube cells 49. In accordance with the invention, water flows downwardly through the ice forming mold 48, and is collected in sump 55.

The level of water, and hence the quantity of water in sump 55 may be controlled by a float valve 56. Water, which is removed from the sump (such as by its formation into ice), may be made up from an outside source through supply line 57 via make up pipe 58. When the water level in the sump 55 has risen to the predetermined level, float valve 56 closes, thereby shutting off the supply of water to the sump. Water can be flushed from the sump via a dump valve (not shown) which can be opened by a control system, thereby preventing the build-up of solids in the sump which may occur during use. Make up water can be supplied to the sump continuously during the freezing cycle or, as described in more detail below, supplied to the sump only at the start of the ice making cycle.

Figure 10:
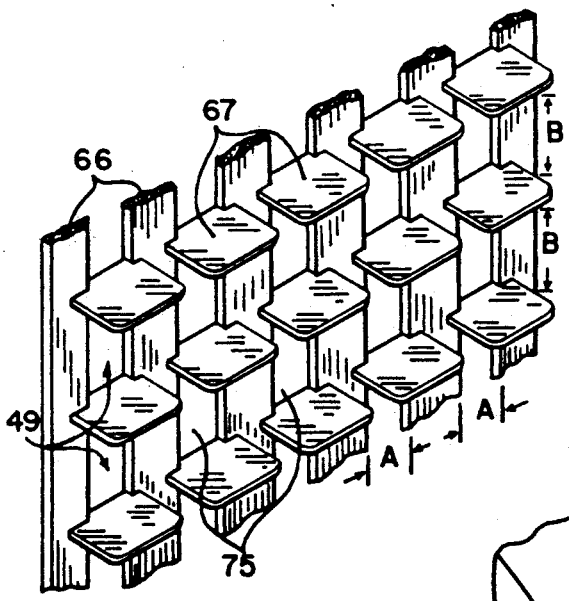
FIG. 10 is a perspective view of one embodiment of the vertically oriented conveyor of the present invention.

In accordance with the present invention, the conveyor 35 forms a first side 65 of the ice forming mold 48. In keeping with this aspect of the invention, and as shown in the preferred embodiment of FIGS. 4, 5 and 8, the conveyor is preferably made up of one or more belts 66, which are arranged in spaced relation, and which are interconnected by a plurality of fingers 67. The belts are preferably separated by a predetermined distance A, as best shown in FIG. 10, and the fingers are arranged to project outwardly therefrom. Together the belts 66 and fingers 67 form the conveyor 35, and translate about first and second wheels 37 and 38.

As best shown in FIG. 10, each finger 67 joins two belts 66, and each is spaced a predetermined distance from the adjacent finger. Furthermore, each row of fingers 67 is spaced a predetermined distance B from each adjacent row. By varying the distance between the fingers, and as will be explained in greater detail below, one skilled in the art will appreciate that the cells 49 of ice machine 10 can be sized to produce cubes of varying volumes.

Figure 8:
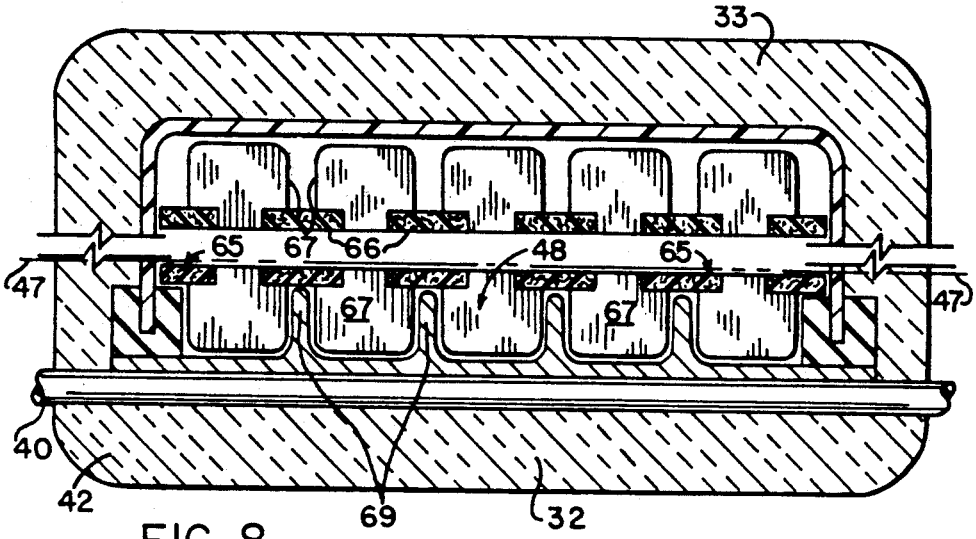
FIG. 8 is an enlarged, fragmentary cross-sectional view taken along line 8—8 of FIG. 5 illustrating the freezing chamber of the vertically oriented ice forming and harvesting mechanism.

The opposing or second side 68 of ice forming mold 48 is comprised of a series of vertically oriented metallic vanes 69, which are in close thermal contact with evaporator coils 40. As shown in FIG. 8, the vanes 69 are arranged in spaced relation, and extend between fingers 67 from side wall 32 to the belts 66. The vanes 69 thus cooperate with the belts 66 and fingers 67 to guide conveyor 35 as it moves through the ice forming chamber 46, and serve to define a close lattice structure comprising a plurality of ice forming cells 49. As those skilled in this art will appreciate, water delivered across the top of the lattice structure will run downwardly through the freezing chamber, with portions thereof freezing in the cells of the lattice as the water trickles across the belts and fingers of the conveyor and the vanes of the ice forming mold.

As stated earlier, conveyor 35 rotates about first and second wheels 37 and 38. As shown in FIG. 5, second wheel 38 is preferably partially submerged in sump 55 so that the conveyor passes through the water to remove any ice or other solids adhered thereto.

Figure 11:
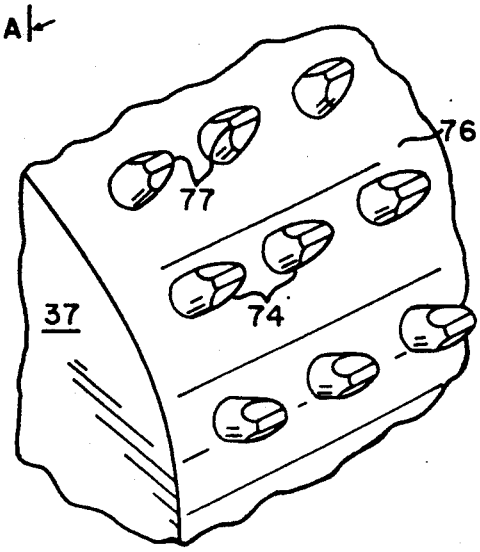
FIG. 11 is a second, preferred embodiment of the harvesting pulley having outwardly-extending projections.

The first wheel 37 is driven by gear motor 70 and is coupled thereto by drive shaft 71. As best shown in FIG. 11, the first wheel 37 has a plurality of radially extending projections 74 which are spaced to be in registration with the openings 75 in conveyor 35 defined by belts 66 and fingers 67. (See FIG. 10.) In accordance with one aspect of the invention, projections 74 extend radially beyond the surface 76 of first wheel 37 a distance sufficient to loosen and harvest the formed ice which has adhered to the conveyor as the conveyor rotates over the first wheel 37. The harvested cubes are then caught by chute 80 and directed to a laterally spaced ice storage bin as shown in FIG. 2.

Figure 12:
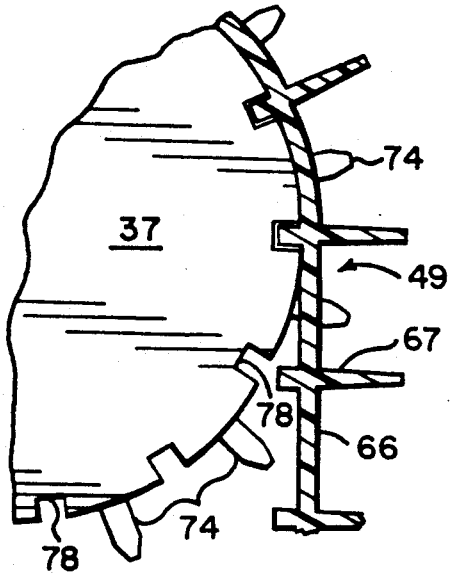
FIG. 12 is a cross section of an alternative embodiment of the harvesting pulley and belt conveyor of the present invention with guides on the conveyor and complementary notches on the harvesting pulley to ensure proper registration therebetween.
Figure 9:
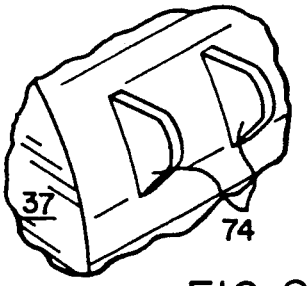
FIG. 9 is an exploded perspective view of a preferred harvesting pulley having outwardly-extending projections.

The projections shown in FIG. 11 are pin-like and taper to a flat tip 77; alternatively, and as shown in FIG. 9, the projections 74 could have a rounded profile which can assist in driving the conveyor. In a still further embodiment of first wheel 37 illustrated in FIG. 12, the surface 76 of the wheel can be scored with axial notches 78 which are evenly spaced to accept complementary, inwardly extending guides 79 associated with the fingers 67 of the conveyor 35. In this way, the notches and guides cooperate to prevent the conveyor from slipping on the drive wheel 37 and also ensure that the projections 74 and openings 75 will be in proper alignment.

Figure 3:
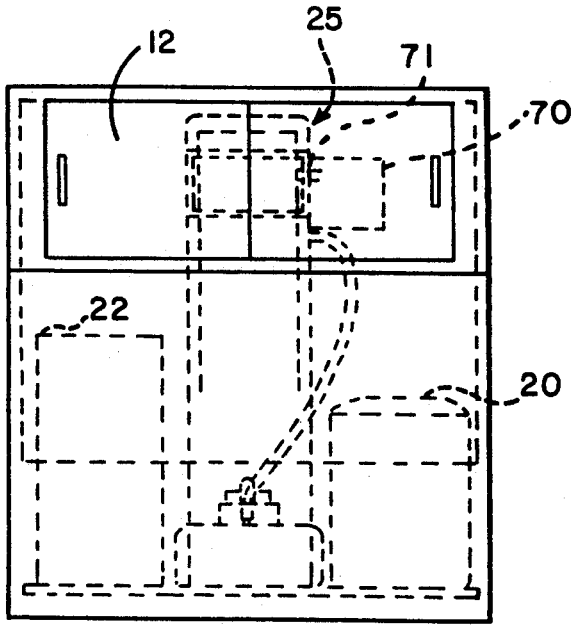
FIG. 3 is a front elevational view of the ice machine of the present invention with the arrangement of certain internal components shown by dotted lines.

The refrigeration system is partially shown in FIGS. 2 and 3, with further details in FIGS. 4 and 5. As is well known to those skilled in this art, a liquid refrigerant is fed through a supply line through an expansion control valve and into evaporator coils 40, which form a portion of the ice cube freezing mechanism 25. The coils 40 feed into a return suction line, which is connected to the suction side of the compressor 20. The refrigerant is compressed by the compressor 20 to a high pressure and temperature and is discharged through a discharge line into the condenser 22, which condenses the hot gas back into a liquid. A hot gas bypass line is connected from the discharge line through a normally closed solenoid valve to the evaporator coils.

During a freezing cycle, the refrigeration system operates normally and as water flows by gravity downwardly into the ice forming mold, the capillary action of the water with respect to the vanes and fingers permits the water to follow the walls of the lattice structure thereby wetting the entire surface of the ice forming mold and its associated lattice structure. The cooling effect provided by the low pressure refrigerant passing through the evaporator coils chills the ice forming mold, causing the water passing downwardly therethrough to freeze. At a predetermined point, the normally closed solenoid valve is actuated, thereby permitting hot gas to flow directly from the compressor 20 through the hot gas bypass line and into the evaporator coils 40. This frees the formed ice from the vanes 69.

The refrigeration system of the present invention has been designed to remove 75,000 BTU/day with an inlet water temperature of 50° F. and a condensing temperature of 105° F. With these design parameters, and using R-12 refrigerant, ice machine 10 can produce approximately 330 pounds of ice per day.

Figure 7:
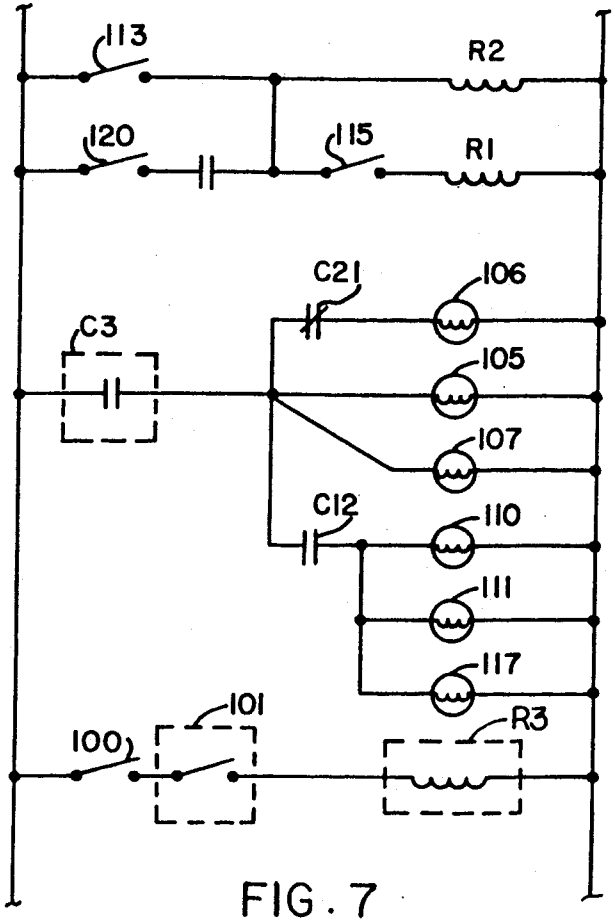
FIG. 7 is a schematic view of a preferred control system.

The control system 90 for the ice machine is illustrated schematically in FIG. 7, and the operation of the ice machine 10 is best understood with reference to this FIGURE. The ice machine is preferably powered by a standard 115 volt A.C. power supply and is conventionally provided with an on/off switch 100. With switch 100 closed, power is supplied to normally closed bin level switch 101, which may be a thermostat or a mechanical switch and which closes when the ice in the storage bin drops below a predetermined level. When the bin level switch is closed, relay R3 is energized and closes contact C3, thus energizing compressor motor 105 and triggering the start of an ice making cycle.

When the refrigeration system initially begins its freeze cycle, the make up water solenoid 106 and coil 107 of water pump 52 are energized, and the coil 110 of gear motor 70 and hot gas valve 111 are deenergized. Water will continue to fill the sump until the normally open water fill switch 113 closes, energizing relay R2. The water fill switch may be actuated by a float, or may consist of an electronic probe. When relay R2 is energized, contact C22 is closed and contact C21 is opened. In this way, the make up water solenoid 106 is de-energized, stopping the flow of water to the sump. During this time, the normally closed harvest switch 115 is opened. As the refrigerant continues to cycle, the refrigerant in the evaporator coils 40 cools the vanes 69 in freezing chamber 46. At the same time, water is pumped by pump mechanism 52 to the header 54 located above the ice forming mold 48. The water delivered by the header flows downwardly into the mold between vanes 69 and fingers 67. As this water cools, it freezes to form ice, and since this ice is being formed from circulating water, it has a high degree of clarity.

During the freeze cycle, the water level in the sump gradually drops until it reaches a set point which triggers the closing of the harvest switch 115, which energizes relay R1 causing contact C12 to close. This set point coincides with the formation of ice cubes along the length of the ice forming mold 64 in freezing chamber 46.

When contact C12 is closed, the coil 110 of gear motor 70, hot gas valve 111, and dump valve 117 are energized. Energizing the dump valve 111 removes excess water from the sump, so that the next freezing cycle begins with fresh water. Energizing the hot gas valve causes hot gas from the compressor to bypass the condenser 22 and flow directly to the evaporator coils 40. The hot gas in the evaporator coils warms vanes 69, which loosens the ice therefrom to allow for easy withdrawal of the first side 65 of the ice forming mold (conveyor 35) from the freezing chamber 46. As the hot gas heats the evaporator, the gear motor 70 will attempt to turn the belt. The gear motor is preferably designed to remain in a stalled condition until the ice is loosened from the second side or evaporator surface 68 and is no longer adhered thereto. Once the ice is loosened, the torque of the stalled motor is sufficient to turn first wheel 37 in a clockwise direction, as viewed in FIG. 5. Driving first wheel 37 clockwise withdraws that portion of the conveyor 35 forming a first side of the ice forming mold through the upper end of the freezing chamber 46. As that portion of the conveyor is withdrawn, the leading edge engages projections 74 extending outwardly from first wheel 37. As the belts 66 of the conveyor conform to the shape of the first wheel 37, projections 74 push the formed ice into chute 80.

The conveyor will continue to rotate until a normally closed belt switch 120, either actuated by a tab or magnet on the belt, is opened momentarily. Opening the belt switch causes relay R2 to open contact C22 and close contact C21, thus energizing the water make up solenoid 106. At the same time, relay R1 opens contact C12, causing the gear motor to stop, and the hot gas valve and dump valve to open. The freeze cycle is thus repeated and refrigerant again passes through condenser 22 to begin cooling evaporator coils 40. In the event the bin level switch 101 is held open, indicating that the bin contains a predetermined quantity of ice, relay R3 opens contact C3, de-energizing the compressor, water pump and make up solenoid.

Figure 6:
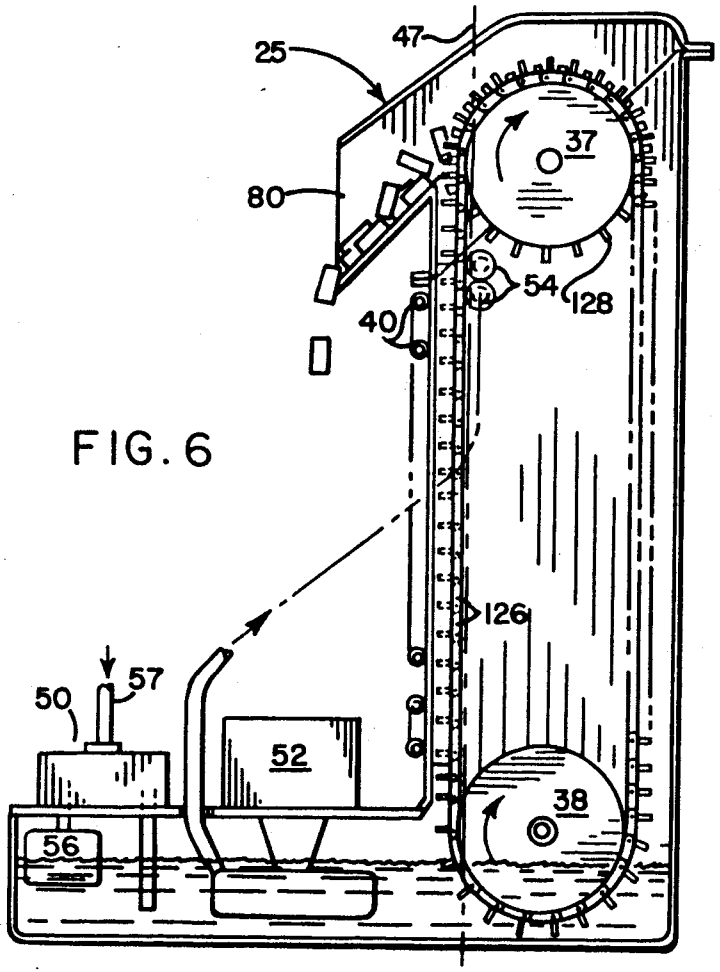
FIG. 6 is a cross-sectional view of a second, preferred embodiment of the ice-forming mechanism of the present invention.
Figure 13:
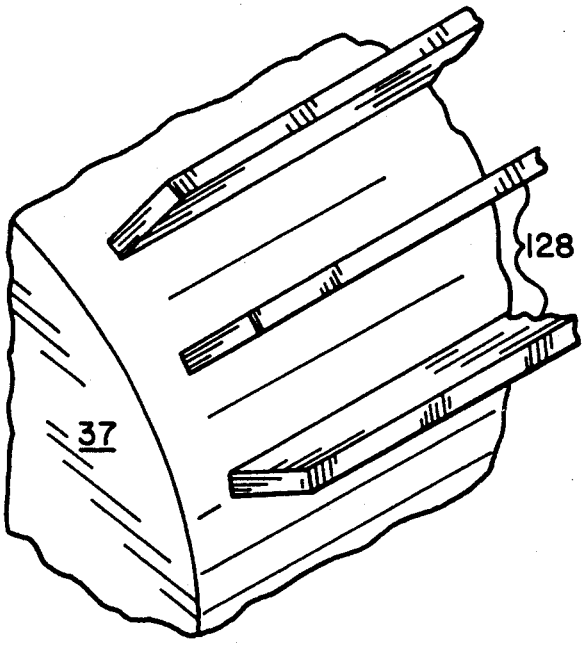
FIG. 13 is a perspective view of the harvesting pulley of the preferred embodiment shown in FIG. 6.
Figure 14:
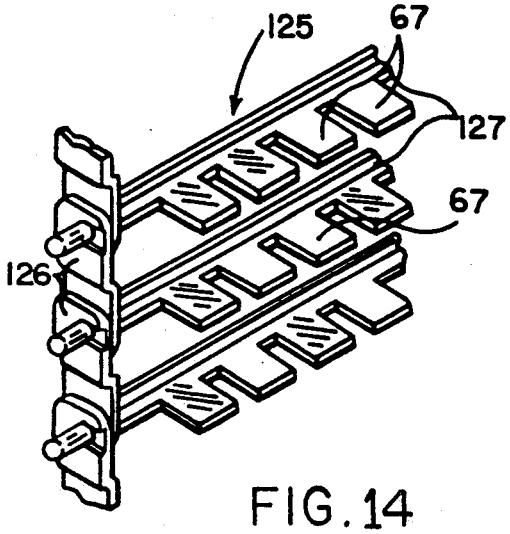
FIG. 14 is a perspective view of the alternative chain conveyor of the preferred ice-forming mechanism shown in FIG. 6.

A further embodiment of the ice making system is shown in FIG. 6. This embodiment differs from that shown in FIG. 5 in that the conveyor is an endless chain 125 comprising links 126 which carry flights 127 in which fingers 67 are formed as shown in FIG. 14. The fingers 67 adjacent the first wall 32 of the housing are separated by vanes 69 projecting inwardly therefrom. The fingers and vanes thus form a lattice structure comprising a plurality of individual ice forming cells 49. Ice which is formed in these cells is ejected therefrom by flat paddles 128, as shown in FIG. 13, which are adapted to fit between the horizontal links 126 of conveyor 35 as the conveyor is rotated around first wheel 37. In all other respects, the operation of the ice machine shown in FIG. 6 is identical to that illustrated in FIG. 5.

Those skilled in the art will appreciate that the present invention can encompass many variations. For example, the size and capacity of ice machine 10, including the components thereof, can be scaled upwardly or downwardly to provide the desired ice making capacity and speed. Moreover, in addition to increasing the dimensions of the components of the ice making system, additional ice forming structures could be provided in a multiplex arrangement, thereby increasing the capacity of the system without adding an additional refrigeration system. As a further example, those skilled in the art will appreciate that the control system illustrated in FIG. 7 could be replaced by cams attached directly to drive shaft 71, or a separate control arrangement could be used to actuate switches, counters, or the like.

I claim as my invention:

1. An ice machine comprising, in combination, a housing forming a chamber having a substantially vertically oriented sidewall, an endless conveyor having a plurality of outwardly extending fingers, a portion of said conveyor and said sidewall defining a substantially vertically oriented ice forming mold disposed within said chamber, said mold being divided into a plurality of cube cells, a sump underlying said mold, means for selectively delivering water from said sump to the top of said mold so that water will flow downwardly through said mold and into said cells, refrigeration means for freezing water within said cells of said mold, and means for harvesting the formed ice, said ice harvesting means including means operably coupled with said conveyor for withdrawing the conveyor and the ice formed thereon from the top of said chamber and means for detaching said ice from said conveyor.

2. The combination of claim 1 in which said conveyor comprises a plurality of belts which are interconnected by said fingers.

3. The combination of claim 2 wherein a plurality of vanes extend inwardly from the sidewall of said chamber between adjacent fingers of said conveyor whereby said fingers and vanes define said cube cells spaced evenly along the length of the ice forming mold.

4. The combination of claim 3 wherein the ice harvesting means comprises a wheel having a plurality of projections extending radially therefrom, said projections urging ice from said conveyor when the conveyor rotates about said wheel.

5. The combination of claim 4 wherein the harvesting means includes means for heating said sidewall to release the formed ice therefrom to facilitate the withdrawal of the conveyor from the ice forming chamber.

6. The combination of claim 1 wherein the endless conveyor comprises a chain of links which carry substantially linear flights and said harvesting means comprises a wheel having a series of paddles extending radially therefrom, said paddles urging ice from said links when the conveyor rotates about said wheel.

7. An ice machine including, in combination, an ice cube freezing mechanism and an ice cube storage bin spaced laterally therefrom, said ice cube freezing mechanism comprising a housing forming a chamber having a substantially vertically oriented sidewall and an endless conveyor having a plurality of outwardly extending fingers, a portion of said conveyor and said sidewall defining a substantially vertically oriented ice forming mold disposed within said chamber, said mold being divided into a plurality of cube cells, a sump underlying said mold, means for selectively delivering water from said sump to the top of said mold so that water will flow downwardly through said mold and into said cells, refrigeration means for freezing water within the cells of said mold, and means for harvesting the formed ice, said ice harvesting means including means operably coupled with said conveyor for withdrawing the conveyor and the ice formed thereon from the top of said chamber and means for detaching said ice from said conveyor and directing said ice to the ice storage bin.

* * * * *